United States Patent [19]

Hart et al.

[11] 4,132,986

[45] Jan. 2, 1979

[54] ELECTROMAGNETIC INDICATOR

[75] Inventors: Robert D. Hart, Collinsville; Robert Mazzamauro, Waterbury, both of Conn.

[73] Assignee: General Time Corporation, Thomaston, Conn.

[21] Appl. No.: 823,169

[22] Filed: Aug. 9, 1977

[51] Int. Cl.[2] ..... G08B 5/22

[52] U.S. Cl. ..... 340/373; 340/381; 340/378.5

[58] Field of Search ..... 340/373, 378 MW, 381

[56] References Cited

U.S. PATENT DOCUMENTS 3,573,812 4/1971 Pihl ..... 340/373

*Primary Examiner*—Harold I. Pitts

*Attorney, Agent, or Firm*—Pennie & Edmonds

[57] ABSTRACT

An indicator flag is movable alternately into one of a plurality of display positions thereby to provide a distinguishable visual indication in each position. The indicator flag carried by a movable assembly is actuated by electromagnetic means and the movable assembly is latched in each display position. A pair of switches are associated with and controlled by the movable assembly from a normally closed to an open condition. The switches may function variously to control associated equipment or switch the electromagnetic means so that drive energy is required only during transition of the indicator flag from one of the plurality of display positions to another, among others.

5 Claims, 7 Drawing Figures

ELECTROMAGNETIC INDICATOR

BACKGROUND OF THE INVENTION

The present invention is related to apparatus of the type providing a two-state display under the control of electromagnetic means and includes an improved switching arrangement. The display is provided by an indicator flag carried by a movable assembly mounted for rotation on a supporting structure. The indicator flag is positioned to provide a visual indication of a condition being monitored. The switching arrangement including a pair of switches is controlled by the movable assembly in a manner that respective switches are actuated to an open state from a normally closed state in substantial coincidence with a change of the visual indication. The switches may control a host of functions such as triggering a clock pulse of a logic circuit of associated equipment or they may switch the electromagnetic means so that drive energy is required only during transition of the indicator flag, among others.

Apparatus of this general type are known in the prior art. Such apparatus generally have been found to employ a member or indicator flag having discernible indicia or other discernible markings thereon such that energization of an electromagnetic assembly which may result from a change in a monitored condition causes the member to move from a first limit position to a second limit position or vice versa.

The prior art typically includes apparatus having members generally as described whereby a first display may be presented through movement of the member to a first position and a second display may be presented through movement of the member from the first to a second position. The display is adapted to be clearly visible in ambient light without the use of an illuminating source. The members, further, have been associated with means providing a self detenting or latching function in each position and there has been provision of internal switching for various reasons. The prior art apparatus generally has been of the type used to monitor electrical conditions such as the presence or absence of electrical signals in a host of environments which may require operation under conditions of shock and vibration requiring high stability, under conditions likely that there will be an ingress of dust, moisture, etc. into the confines of a housing requiring an hermetic sealing to protect the internal workings, to name to few. Also, the prior art apparatus generally are of the type which are small in size, operable under low power conditions and capable of rapid response.

A particular example of an apparatus of this type, one which substantially satisfies the above requirements, is disclosed in U.S. Pat. No. 3,573,812 to G. E. Pihl. Upon reference to the Pihl patent one may obtain insight as to the aspects of Pihl's invention and those to which his particular design of apparatus was directed. While the Pihl apparatus for the most part successfully overcame certain problems in the prior art as of the time of Pihl's invention which has been rather favorably received, the Pihl apparatus has been found not totally acceptable for reasons of complexity of structure and the costs of fabrication as well as, more importantly, problems relating to switch operation and design.

SUMMARY OF THE INVENTION

It is an important aspect of the present invention to provide an apparatus including a movable assembly including an indicator flag and a switch arrangement which is an improvement over those apparatus of the prior art exemplified by the above-noted patent to G. E. Pihl.

In addition to the construction of the apparatus of the present invention being of a design which lends itself to ease in fabrication rendering it less expensive, and that the manner of switch operation is both simple and reliable under conditions of use, the switch arrangement improves upon the prior art in other ways, as well. Thus, actuation of the switches to an open condition is a positive actuation of a movable contact relative to a stationary contact wherein there is no need of adjustment as in the prior art. The operation is one which successfully eliminates contact bounce and noise associated with the prior art. In the present invention the contacts are held open when the movable assembly is latched and there is no loss in sensitivity in the switch since it is not part of the magnetic circuit, also as in the prior art. Further, the apparatus of the present invention without adverse affect in switch operation is able to withstand a "g" level which is higher than that of the prior art by a factor of about 3.

These and other aspects of the present invention may be achieved through construction of an apparatus having an electromagnetic assembly including a pair of spaced apart pole pieces, a movable assembly including a permanent magnet mounted for rotation about an axis between two limits determined by the position of the pole pieces upon energization of the electromagnetic assembly, an indicator flag forming a part of the movable assembly adapted for providing a visual indication, and two pairs of switch contacts which are disposed so that one pair of contacts is opened by a wiping action of the permanent magnet as it approaches and resides in the first limit position and the other pair of switch contacts is opened by a wiping action of the permanent magnet when it approaches and resides in the other limit position. One of the contacts of each pair of switch contacts is disposed so that is is engaged by the permanent magnet during its transition from the first to the second position and in return to the first limit position. The two pairs of switches have their contacts disposed to close upon movement of the permanent magnet away from a limit position associated with that switch. And there may be an interval of time during which both switches are closed. The indicator flag moves conjointly with the permanent magnet to provide a visual indication at each limit position. The permanent magnet is rotated from one to the other of its two limit positions in accordance with the energization of the electromagnetic assembly so that the permanent magnet will be repelled by a field concentrated at the nearest pole piece and attracted by a field concentrated at the other pole piece to which the permanent magnet will reorient itself. The switch contacts of each pair of switch contacts are formed by a wire contact which is immovably positioned and a contact cam which is disposed in a position thereby to be actuated from a normal switch closed position upon movement of the permanent magnet under conditions as heretofore described.

There has thus been outlined rather broadly the more important features of the invention in order that the detailed description thereof that follows may be better understood and in order that the present contribution to the art may be appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DESCRIPTION OF THE DRAWING

Other aspects, features, and advantages of the present invention will be presented within the following detailed description, all of which will become clear upon reading the description in conjunction with a consideration of the drawing, wherein.

DESCRIPTION OF THE PREFERRED EMBODIMENT

Figure 1:
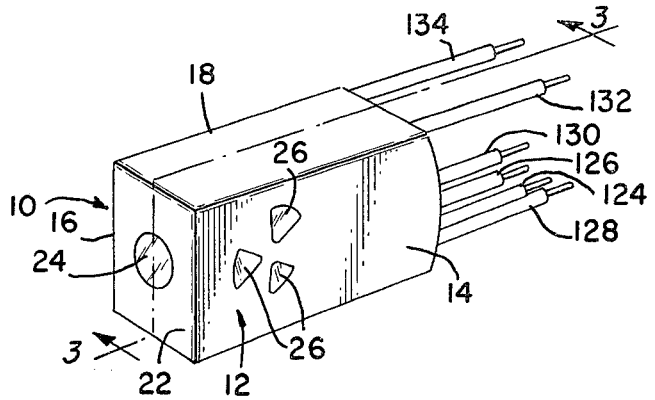
FIG. 1 is a perspective view of the apparatus which embodies a preferred form of the present invention.

The apparatus which embodies the preferred form of the present invention is denoted by the numeral 10 in FIG. 1. The apparatus includes a movable assembly including an indicator flag adapted to provide a visual indication, an audible indication with activating structure and/or circuitry is contemplated, also, an electromagnetic assembly which upon energization causes the movable assembly to locate to one or the other of a pair of stable positions, switching means and structure providing support, all as will be brought out below. This structure may be received by a housing 12 of rectangular cross-section having front and rear walls 14 and 16, which are connected together by a pair of side walls 18 and 20. A top wall 24 partially encloses the interior of the housing. A bottom wall or the equivalent such as a potting material as is well known in the art will complete the enclosure following receipt into the housing of the above structure.

The housing is formed of a material which preferably shall display characteristics of rigidity, sturdiness, longevity in life, to name a few. The housing preferably should be formed of a nonmagnetic material or otherwise magnetically insulated from the electromagnetic assembly enclosed therein so as not to effect the operation of the apparatus. Thus, the housing may be formed of certain metals and plastics, all as well known. Preferably, however, the housing is formed of a carbonate polymeric material, sold under the trademark LEXAN. LEXAN is a product of the General Electric Company, Schenectady, New York. The material is transparent. Therefore, the walls throughout substantially their entire surface, except for an area 24 of circular outline within the top wall and an area 26 formed by a plurality of equiangular truncated sectors within the front wall, are coated with an opaque material. These areas comprise windows through which the visual indication may be perceived. The material comprising a coating 28 (see FIG. 3) may be of any particular color that provides a visual contrast with the transparency of the window. For example, the coating, preferably non-glare, may be a black, red, or any other color distinguishable from clear plastic, and may be painted on or otherwise applied to the surface.

While the use of a transparent plastic is preferred it should be apparent that other plastics or even metals, all of which are opaque, may be employed. In this event the windows 24 and 26 will comprise cutouts or the equivalent closed by a transparent member so that the indicator flag within the housing 12 may be viewed.

Figure 2:
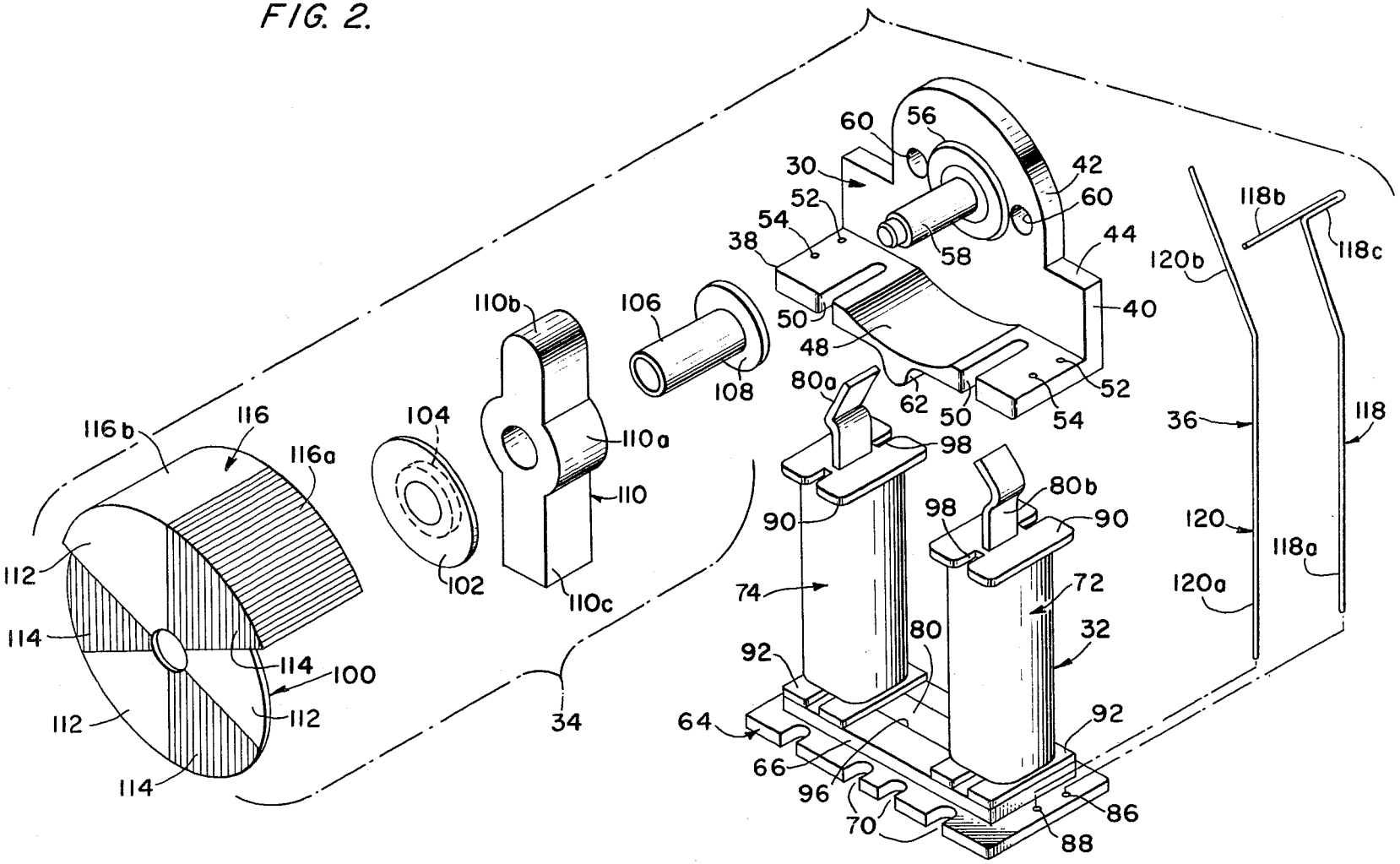
FIG. 2 is an enlarged view in perspective of various components of the apparatus exploded from an assembled state.

Referring now to FIG. 2, there is an illustration of the structure referred to above. To assist in this illustration the components are exploded from an assembled package. The support structure is denoted by the numeral 30, the electromagnetic assembly by the numeral 32, the movable assembly by the numeral 34 and the switching means by the numeral 36.

The support structure hereinafter referred to as a "platform" includes a base 38 and an upstanding wall 40 including a central domed portion 42. The base is of rectangular outline and dimensioned thereby to be received within and frictionally supported by the walls of housing 12. The wall may be integral with or otherwise carried on base 38 such that it is received in juxtaposition to the rear wall 16. A pair of shoulders 44 on either side of the central domed portion cooperate with the shoulders 46 formed in side walls 18 and 20 to locate the platform in the housing 12.

A recess 48 having a cylindrical surface is formed in the upper surface of base 38. The recess extends across the base perpendicular to the wall 40. A pair of slots 50 extend from the front of the base toward the wall. Both slots are positioned equidistantly from and parallel to the axis of recess 48. A pair of apertures 52 and 54 are located between the slots and the edge of the base. The apertures 52 are located adjacent to the wall 40 and the apertures 54 are spaced therefrom in alignment with the edge. As will be brought out, the electromagnetic assembly 32 will be supported on platform 30 or vice versa by virtue of slots 50 receiving the core of the coil assemblies; the switching means will be received through the apertures 52 and 54; and the movable assembly will be permitted movement rotationally in an arc concentric with the surface of recess 48.

A boss 56 is disposed within the domed portion 42 and a post 58 is supported by the boss. The axis of the post is perpendicular to the plane of wall 40. A further pair of apertures 60 are disposed outwardly of the boss within the area of the domed portion 42. And, a rib 62, formed on the underside of of base 38, extends along the axis of recess 48.

The electromagnetic assembly 32 includes a printed circuit tabbing board 64, hereinafter referred to as the "tabbing board," which is of an outline like that of the base 38 and similarly received within the housing 12 thereby to be supported between the walls. In the assembled arrangement the tabbing board will be disposed adjacent to the bottom of the housing and provides support for the remainder of the components of the electromagnetic assembly. A spacer 66 is supported on the tabbing board within its central region. The spacer, likewise, is rectangular in outline although of a dimension smaller than that of the tabbing board so that there is a border therearound. A plurality of grooves 68 are formed within the border along one side of the tabbing board and a like plurality of grooves 70 are formed along the other side. The grooves are of a depth substantially equal to the width of the border and directed toward one another from opposite sides of the tabbing board. See FIG. 5B.

The electromagnetic assembly further comprises a pair of coil assemblies 72 and 74, each formed by a bobbin 76, a winding 78 and a core 80.

Figure 5A:
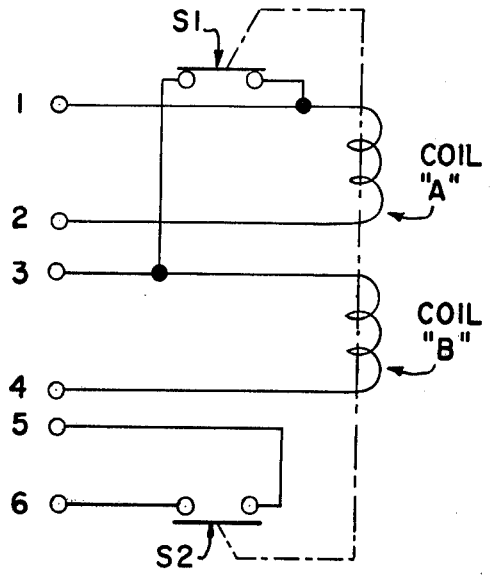
FIG. 5A is a circuit schematic of one form of arrangement of the electromagnetic components and switches; and, FIG. 5B is a bottom plan view of a tabbing board providing a means for electrical connection.

The tabbing board serves an a terminal board for the connection of the windings A and B in FIG. 5A and at least one of the switches of the switching means to an external circuit such as described above.

Figure 5B:
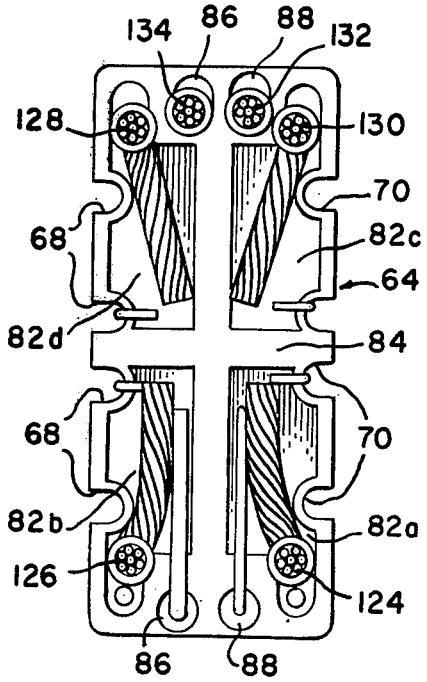

The tabbing board is formed of a glass base epoxy material and provided with a plurality of contact surfaces. Thus, in FIG. 5B, a contact surface 82*a*, 82*b*, and so forth are located in each of the four quadrants on the underside of the tabbing board and separated from adjacent contact surfaces by a nonconductive surface portion 86 having the outline generally of a cross. At least one of the grooves 68 and 70 on the opposed sides of the tabbing board is formed to extend within the area of one of the contact surfaces thereby providing a space through which a connector connecting the ends of windings A and B may pass. The winding A may comprise the winding of coil assembly 72 and the winding B may comprise the winding of coil assembly 74. Referring to FIG. 5B, the ends of winding A may be connected to contact surfaces 82*a* and 82*d*; while the ends of winding B may be connected to contact surfaces 82*b* and 82*c*.

Two pairs of apertures 86 and 88 are formed in the borders adjacent to the borders in which are formed grooves 68 and 70. These apertures support the switch contacts of the switching means S 1 and S 2. As seen in FIG. 5B, the switch contacts of switching means S 1 extend through one of the apertures 86 and 88 and are connected to contact surfaces 82*a* and 82*b*; while the switch contacts of switching means S 2 extend through the other of the apertures 86 and 88.

Returning to FIG. 2, the bobbins 76 are mounted on the spacer 66. The bobbins are of like construction, each including a pair of end flanges 90 and 92 which are spaced apart by a body 94 having a rectangular cross section. The end flanges and the body of each bobbin include an opening of rectangular cross section for purposes of supporting the core 80. The core 80 is of U-shaped outline and the bobbins 76 are mounted on its legs. A rectangular slot 96 formed lengthwise of spacer 66 receives the base of the core between the legs so that the end flanges 92 of bobbins 76 are juxaposed to the surface flanges of the spacer. Each of the end flanges of both bobbins are provided with opposed slots 98 extending from each end of the opening for purposes as will be described. The core 80 preferably will be of a soft iron material. And, as may be apparent, the windings 78 of coil assemblies 72 and 74 comprising winding A and B are wrapped through a number of turns around body 94 between end flanges 90 and 92 according to conventional practice to obtain the operation desired. For example, the apparatus may be operated at various voltages (DC) such as 1.5, 3, 6, 12 and so on up to some maximum which may be about 28 volts. A typical wire size with a voltage of 3 volts may be 43 AWG, while a wire size of 46 AWG may be used at a voltage of 12 volts. A larger wire size may be used if the voltage is increased. As the voltage is increased the number of turns will be increased such that, for example, the winding may consist of 1000 turns at 6 volts and 2000 turns at 12 volts with a coil resistance of approximately 60 and 240 ohms, respectively. The windings may be covered with a conventional tape and the ends will be passed through respective slots 98 in end flanges 92 for suitable connection to the contact surfaces which may comprise a copper or similar conductive coating. The slots in the end flanges 90 have no function in the orientation of bobbin but permit mounting of the bobbins 76 so that either of the end flanges may be disposed downwardly.

The tabbing board 64 is illustrated as including a plurality of four grooves 68 and 70 in opposite borders. Two grooves in each side accommodate the ends of the windings A and B. The remaining grooves may accommodate the leads of other electrical components as may be required for prevention of the production of high voltage due to inductance of the windings when the excitation current is removed. See FIG. 8 of the Pihl patent.

The movable assembly 34 includes a plurality of components adapted to mount an indicator flag 100 on the platform 30, and particularly the post 58, for back and forth rotational movement between two limit positions. The movable assembly includes a spacer 102 including a bushing 104 and an eylet 106, also having a bushing 108 attached at one end. The assembly illustrated within the brace also includes a magnet 110 having a central circular area 110*a* and a pair of oppositely directed extensions 110*b* and 110*c*. The extension 110*b* is rounded at the extreme end, while the extension 110*c* is of rectangular cross section throughout. Both the indicator flag 100 and spacer 102 are disc-shaped in outline and each of the components which comprise the movable assembly include a central aperture therethrough. To this end the indicator flag 100, spacer 102, bushing 104 and magnet 110 are received around the eyelet 106 which, in turn, is received on post 58 so that the bushing 108 is juxaposed to the boss 56. The bushing and the boss preferably will be formed of an insulating material having a relatively low coefficient of friction so that the movable assembly 34 is freely rotatable about the post under control of the electromagnetic assembly 32. The material may be Teflon.

One surface of the indicator flag 100 is described by a plurality of sectors having a distinguishable visual appearance. The plurality is formed by an even number of sectors which in the preferred embodiment include three sectors 112 each of which is separated by a sector 114 of substantially equal size. One group of sectors, for example, the sectors 112 will be painted or otherwise coated thereby to have the same visual appearance as the coating of housing 12. The sectors 114 similarly are painted or coated to provide the same appearance although visually distinguishable from the sectors 112. A surface 116 extends rearwardly of the first-discussed surface. The surface 116 is described by a portion of a cylinder having an arcuate length equal to the length of the arc of two successive sectors 112 and 114. The surface 116 is painted or otherwise coated so that the areas 116*a* and 116*b* duplicate in visual appearance the sectors with which they join. As may be seen the radii of the sectors joining with the surface 116 is slightly longer than the other radii to position the surface closer to window 24.

As will be described in further detail below the indicator flag 100 of indicator assembly 34 rotates between two limit positions, thereby in one limit position to provide a first visual appearance at the windows 24 and 26 and in the second limit position to provide a second visual appearance at these windows.

The switching means 36 comprises the last of the sub-assemblies forming the apparatus and includes a pair of components defining a wire contact 118 and a contact cam 120. Both the wire contact and the contact cam are of substantially equal length thereby to extend from a position below the tabbing board 64 to a position above the base 38 of platform 30 when the electromagnetic assembly 32 is mounted on the platform 30. The wire contact includes a shank portion 118*a* and an operative or contact portion 118*b* connected to the shank by a length 118*c* including a double bend. The wire contact of each switch is supported within the apertures 52 within the base 38 of platform 30 as well as within the apertures 86 in the tabbing board 64. A small amount of an epoxy material may be used to maintain the wire contact in a position of longitudinal stability. As illustrated in the figures, the wire contact 118 is bent within the region of the base 38 thereby to be directed toward the apertures 60 into which the length 118*c* is received. A small amount of an epoxy may be used to secure this portion of the wire contact. Many forms of an epoxy may be utilized for purposes of support of the contact cam and other structures. An epoxy used successfully is "Scotchweld" No. 1838, a product of the 3M Company.

The wire contact may be formed of copper wire such as 28 AWG copper wire and plated with gold to a thickness of approximately 0.00010 inches.

The contact cam 120 includes a shank portion 120*a* which likewise extends from a position below the tabbing board 64 to a position above the base 38 of platform 30. The operative or contact portion 120*b* of the contact cam when mounted likewise is bent so that is will be directed toward and normally in contact with the contact portion 118*b* of wire contact 118. To this end the contact cam of each switch is received through the apertures 88 of the tabbing board 64 and through the apertures 54 in base 38 of platform 30.

In assembly, the electromagnetic assembly 32 is received on the platform 30 in a manner such that the rib 62 on the lower surface of the base is disposed between the end flanges 90 of bobbins 76 and the ends of the core 80 are received through the slots 50. In this position the lower surface of the base will be disposed on the upper surface of the end flanges. The ends of the core, after having received the bobbins thereover, will have been bent twice to provide offset portions 80*a* and 80*b*. The offset portions comprise pole pieces and stops for the extension 110*c* of magnet 110. The stops comprise the first and second limit positions of the movable assembly 34.

The movable assembly 34 first is unitized by flaring the end of the eyelet 106 over the sectored surface of indicator flag 100. The movable assembly may be considered a rotor which is then received around post 58 of platform 30 to be attracted and repelled by the pole pieces. The magnet 110 is polarized axially such that ends 110*b* and 110*c* may be a north pole and a south pole, respectively, or vice versa. The magnet and indicator flag 100, also, are disposed so that the axis of the magnet is along the radius separating the sectors to which the surface 116 is joined.

The platform 30, electromagnetic assembly 32, movable assembly or rotor 34 and switching means 36 are received within housing 12 to a position that the shoulders 44 abut against the shoulders 46 along the inside surface of sidewalls 18 and 20. The flared over portion of the eyelet 106 serves as a thrust bearing against the inside surface of the front wall 14 to maintain the positioning of the indicator flag 100 with respect to windows 24 and 26.

Figure 3:
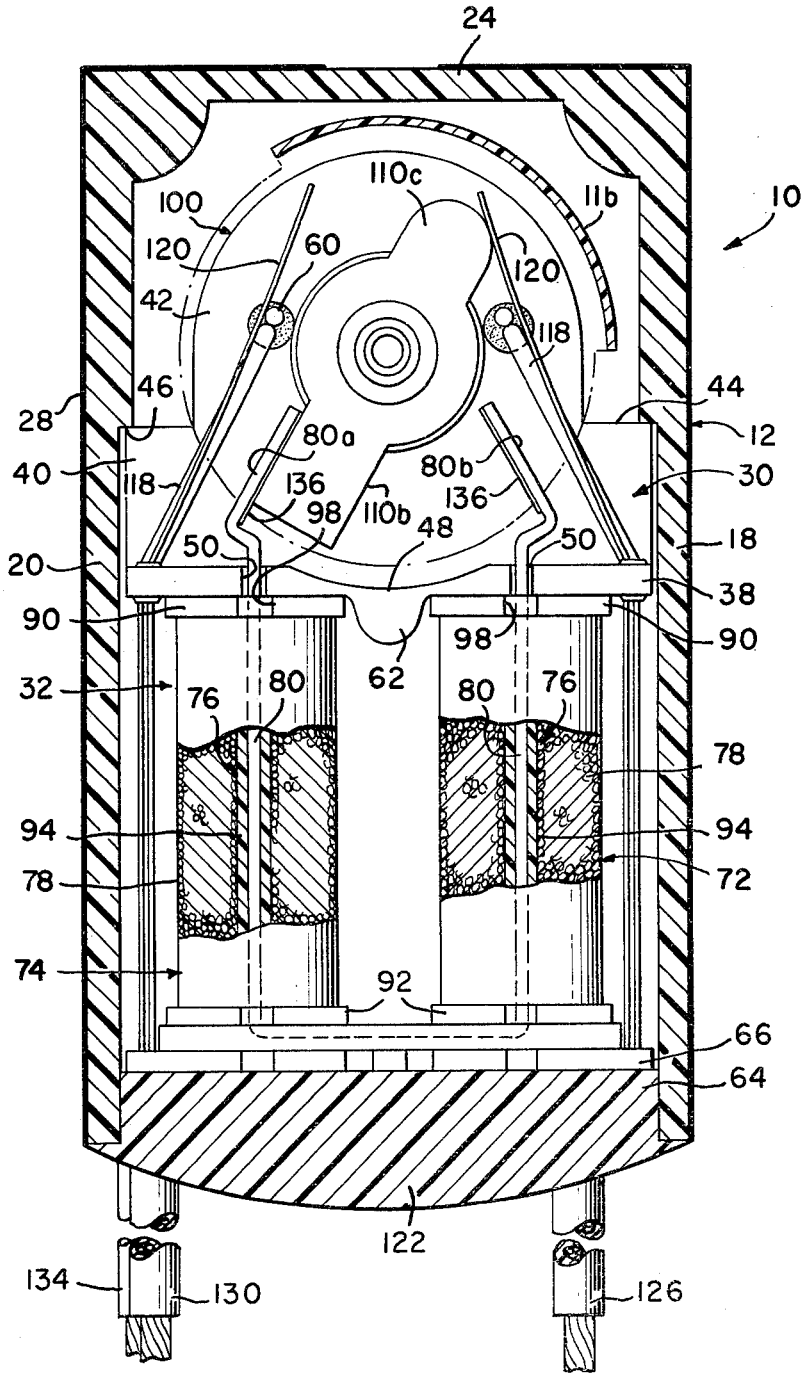
FIG. 3 is an enlarged sectional view in elevation of the apparatus as seen along the line 3—3 in FIG. 1.

Referring to FIG. 3, the various components as described above are seen in their assembled orientation. Thus, the shoulders 44 of the platform 30 and the shoulders 46 of the sidewalls of the housing are in abuting relation, the end flanges 90 of bobbins 76 are disposed against the lower surface base 38 and the undersurface of the tabbing board is disposed within the enclosure of the housing. The undersurface of the tabbing board having the contact surfaces 82*a*, etc., thus will be positioned to effect a final electrial connection before closing the housing by a backfill of an epoxy 122. The tabbing board, first, may have been sealed around its edges to the interior surface of the housing to retain the orientation of structure as heretofore described. The electrical connectors including connectors 124, 126, 128 and 130 are connected to the contact surfaces 82*a*, 82*b*, 82*c* and 82*d*, respectively. These comprise the connectors denoted in the figure as the "red" (1), "green" (3), "orange" (4), and "black" (2) connectors of the circuit in FIG. 5A. The connectors 132 and 134 denoted in the figure as the "blue" (5) and "brown" (6) connectors are connected to the terminals of switch S 2. The several connectors should be supported by the epoxy backfill thereby to be capable of withstanding at least about a one pound pull.

Figure 4A:
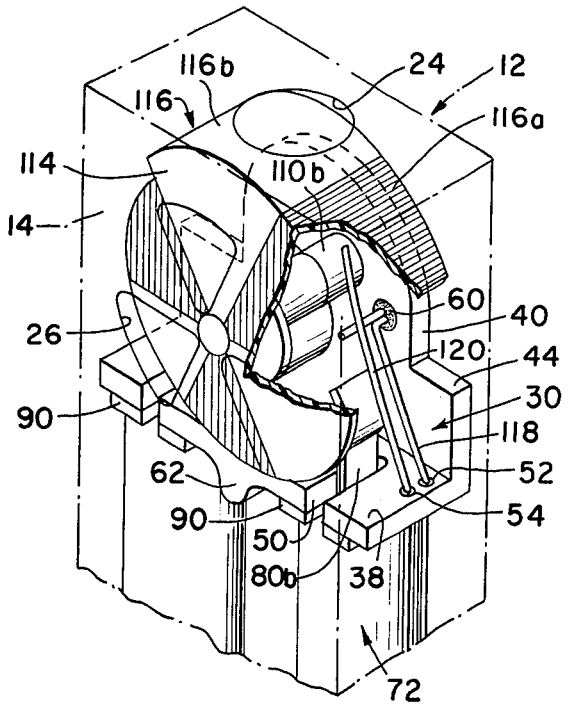
FIG. 4A and 4B are enlarged perspective views of the movable assembly and switches as seen from different directions illustrating the switches under control of the movable assembly in two positions or operation.
Figure 4B:
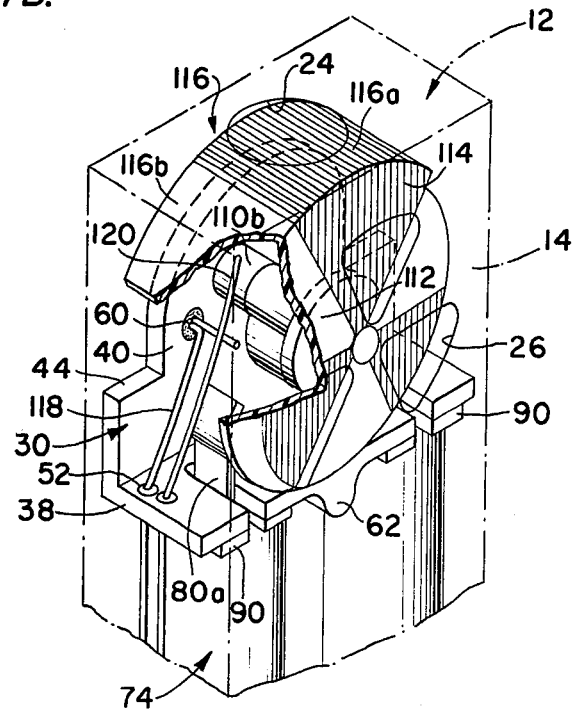

The operation of the apparatus may be appreciated by referring to FIGS. 4A and 4B. FIG. 4A illustrates the fault (set) condition of the apparatus represented by the movable assembly disposed in a first limit position following clockwise transition. In this disposition switch S 1 is in the open state while switch S 2 is in the closed state. FIG. 4B illustrates the no fault (reset) condition of the apparatus represented by the movable assembly 34 disposed in a second limit position following counterclockwise transition. In this disposition switch S 1 is in the closed state while switch S 2 is in the open state. In the latter, the visual indication at the viewing windows 24 and 26 will be like that of the housing, for example, all black; while the visual indication with the movable assembly in the former disposition will be one of contrast with the housing, for example, white with black. It should be apparent that the visual indication could be reversed, if desired.

Assume that the end 110*c* of magnet 110 is polarized as a south pole and the magnet is "latched" by magnetic attraction to pole piece 80*a* of core 80. Preferably the pole piece as well as the other pole piece 80*b* is covered with a strip of a nonmagnetic electrically insulating material as a bumper 136 (Teflon) providing a gap between the end of the magnet and the pole pieces in each limit position. The gap results in a reduction in the magnetic force of the attraction with the result that a smaller magnetic field strength is required to cause the movable assembly to move from one to the other of the limit positions.

Assume also that each of the windings of the coil assemblies 72 and 74 are wound so that when it is energized it will provide a magnetic field which causes the pole piece on the leg of the core which it surrounds to assume a south magnetic polarity while the other leg of the core assumes a north magnetic polarity. Thus, upon energization of coil B the pole piece 80*a* to which the magnet is latched in FIG. 4A becomes a south pole and the movable assembly or rotor immediately is repelled in counterclockwise rotation toward the second limit position. The end of 110c of magnet 110 will be permitted free movement through the recess 48. The energizing current through the coil B should persist for a period of time adequate to repell the magnet from pole piece 80a so that the magnet moves to the other pole piece 80b under the combined forces of magnetic attraction and inertia. The magnet, thereafter, will latch in the FIG. 4B position. And, upon energization of coil A in a like manner the pole piece 80b will become a south pole so that the movable assembly will locate to the FIG. 4A position. Thus, energization of coil A causes the movable assembly to undergo movement from the FIG. 4B to the FIG. 4A position and energization of coil B causes the movable assembly to undergo movement from the FIG. 4A to the FIG. 4B position. During each transition of the movable assembly the switch that is closed will open and the switch that is open will close. The contact arrangement is one wherein there is a make before break although the period during which both switches may be closed is relatively short. A pulse length of approximately 20 milliseconds following a quiescent period during which time the magnet 110 is latched to one of the pole pieces 80a or 80b of core 80 has been found sufficient to achieve the transition desired.

As may be seen in the figures, the end 110b of the magnet 110 as it rotated toward a limit position causes the contact portion 120b of contact cam 120 of each switch S 1 and S 2 to move with it so that the contact portion of 120b of the contact cam separates from the contact portion 118b of the wire contact 118 with which it is associated. As the magnet rotates in the other direction the contacts will close because of the bias of the contacts to the normally closed position. The particular visual presentation at the windows 24 and 26 may be seen to good advantage in FIGS. 4A and 4B and these visual presentations may be correlated with the positions of the magnet 110 and the condition of switches S 1 and S 2.

The illustration of FIG. 5A is representative of one of many circuit arrangements. As shown, switch S 1 is connected so that when closed it completes a circuit between terminals 3 and 2. Switch S 1, also, could be located to connect different terminals or be arranged as switch S 2 is arranged. The particular circuit arrangement will be determined by the operation desired, all as briefly discussed above.

From the above it should be apparent that a new and improved switching arrangement for apparatus of the type herein described has been developed. The switching arrangement is capable of relative ease in manufacture, thereby being less expensive, yet provides positive operation under conditions of use as may be encountered. In fact, the switching arrangement has been found capable of eliminating substantially contact bounce and noise and because of the manner of fabrication adjustment of contact positioning is eliminated. Further, a better latching capability is attained which results in the apparatus withstanding higher "g" levels by a factor substantially of 3. Also, the apparatus is capable of greater sensitivity since the switch is not part of the magnetic circuit. These features and others which may have been perceived cause the present apparatus to be a clear improvement over the prior art.

While a preferred embodiment of the apparatus has both been illustrated and described, it should be understood that the invention will cover aspects all as found within the scope of the invention as recited in the appended claims.

Having described the invention, what is claimed is:

1. An apparatus comprising an indicator having capability sequentially of visual indication of one of a plurality of two states, in each of two dispostions, switch means adapted to be connected in an electrical circuit and including at least one switch which is closed when said indicator is in one disposition and open when said indicator is in the other disposition, means mounting said indicator for movement from said one to said other disposition and in return to the first disposition, means imparting movement to said mounting means, and wherein the improvement is characterized by said switch means comprising a pair of contact members, and means supporting said contact members both in cantilever fashion and in close association with said mounting means, said supporting means including means for fixedly locating one of said contact members relative to the other contact member which normally is biased into contact therewith whereby said mounting means upon movement additionally functions as a switch actuator to open said switch means when said indicator moves toward and into said other disposition and to allow said switch to close when said indicator returns toward said one dispostion.

2. The apparatus of claim 1 wherein each of said contact members comprise an elongated shank portion and a contact portion at one end, and said contact portion of said fixed contact member extending into the path of movement of said other contact member.

3. The apparatus of claim 2 wherein said fixed contact member includes a double bend portion between said shank and contact portions, and said supporting means includes an aperture for receipt and immobilization of said double bend portion.

4. The apparatus of claim 3 wherein said switch means includes a pair of switches, means connecting each of said switches in an electrical circuit whose operation is controlled oppositely by the two switches.

5. The apparatus of claim 1 wherein said mounting means includes a magnet and said movement imparting means includes an electromagnetic circuit for replusing and attracting said magnet whereby said indicator moves from said one disposition to said other disposition and in return to said first disposition, and said switch means consists solely of said contact members.

* * * * *

UNITED STATES PATENT AND TRADEMARK OFFICE

CERTIFICATE OF CORRECTION

PATENT NO. : 4,132,986
DATED : January 2, 1979
INVENTOR(S) : Robert D. Hart and
Robert Mazzamauro It is certified that error appears in the above-identified patent and that said Letters Patent are hereby corrected as shown below:

Column 1, line 48, "to" (third occurrence) should be --a--

Column 4, line 55, "of" (second occurrence) should be cancelled.

Column 5, line 11, "an" should be --as--.

Column 7, line 36, "is", second occurrence, to -- it --.

Column 10, line 17, "dispostions" should be --dispositions--

Column 10, line 37, "dispostion" should be --disposition--

Column 10, line 54, "replusing" should be --repelling--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*